United States Patent [19]

Kurokawa et al.

[11] Patent Number: 4,783,240

[45] Date of Patent: Nov. 8, 1988

[54] LIGHTWEIGHT PAPER AND PROCESS FOR PRODUCING SAME

[75] Inventors: Akio Kurokawa; Naoyuki Ifuku; Kenzo Seita; Youzi Nagata, all of Kanagawa, Japan

[73] Assignee: Mitsui Toatsu Chemicals, Inc., Tokyo, Japan

[21] Appl. No.: 919,878

[22] Filed: Oct. 16, 1986

[51] Int. Cl.[4] ..... D21D 3/00

[52] U.S. Cl. ..... 162/166; 162/181.6; 162/167; 106/287.25; 106/287.34; 106/401

[58] Field of Search ..... 162/167, 181.6, 166, 162/162; 106/288 Q, 288 B, 287.25, 287.34

[56] References Cited

U.S. PATENT DOCUMENTS 3,909,348 9/1975 Economou et al. .
4,132,806 1/1979 Wason .
4,157,920 6/1979 Wason et al. .
4,161,455 7/1979 Wason .
4,183,783 1/1980 Suden et al. ..... 162/181.6 X
4,202,813 5/1980 Wason .

*Primary Examiner*—Peter Chin
*Assistant Examiner*—Thi Dang
*Attorney, Agent, or Firm*—Albert L. Jeffers; John F. Hoffman

[57] ABSTRACT

A lightweight paper having a superior opacity and printing opacity is provided, which lightweight paper comprises dry pulp, 0.015 to 1.2% by weight based on the pulp of an alumina polymer and 0.5 to 30% by weight based on the pulp of a coaggregate formed from agglomerated particles of urea-formal-dehyde polymer (A) and agglomerated particles of hydrated silicic acid (B) in a ratio of (A):(B) of 5:95 to 95:5.

5 Claims, No Drawings

LIGHTWEIGHT PAPER AND PROCESS FOR PRODUCING SAME

BACKGROUND OF THE INVENTION

1. Field of the Invention

This invention relates to a lightweight paper comprising a coaggregate formed from agglomerated particles of urea-formaldehyde polymer and agglomerated particles of hydrated silicic acid, and a process for producing the same.

2. Description of Related Art

Making printing paper and newspaper roll, lightweight has been conducted by making paper thinner, but there may occur an obstacle of the so-called print through. Such print through includes show through due to reduction in the opacity of paper (hereinafter referred to as "opacity") and the so-called strike through that printed ink runs through paper and it is seen from its back surface (hereinafter the extent to which it is prevented will be referred to "printing opacity"). Either of the above physical properties refer to a phenomenon that print on the back surface is seen from the front surface to make reading of print on the front surface difficult; hence such physical properties are most important at the time of making lightweight paper.

Agglomerated particles of hydrated silicic acid are called whilte carbon and have been used for preventing the print through (e.g. U.S. Pat. Nos. 4,132,806, 4,161,455, 4,157,920 and 4,202,813) but they have almost no effect of improving the opacity, and moreover, the percentage fixation thereof relative to pulp at the time of paper-making is so weak that the retention thereof is low.

Further, agglomerated particles of urea-formaldehyde polymer have been used for improving the brightness of paper and the opacity (e.g. see U.S. Pat. No. 3,909,348), but the effect of improving the printing opacity is still insufficient although the agglomerates of urea-formaldehyde polymer has a stronger fixability onto pulp than that of white carbon and hence the percentage retention is higher.

SUMMARY OF THE INVENTION

The object of the present invention is to provide a lightweight paper having superior physical properties mainly brought about by the function of highly improving its printing opacity, while retaining the function of improving the opacity and the high fixability, each of agglomerated particles of urea-formaldehyde polymer.

The present invention in a first aspect resides in a lightweight paper comprising dry pulp, 0.015 to 1.2% by weight based on the pulp of an alumina polymer and 0.5 to 30% by weight based on the pulp of a coaggregate formed from agglomerated particles of urea-formaldehyde polymer (A) and agglomerated particles of hydrated silicic acid (B) in a ratio of (A):(B) of 5:95 to 95:5.

The present invention in a second aspect resides in a process for producing a lightweight paper, which process comprises adding into a pulp slurry, an aluminium salt in a quantity required for forming 0.015 to 1.2% by weight based on dry pulp, of an alumina polymer and further adding agglomerated particles of urea-formaldehyde polymer (A) and agglomerated particles of hydrated silicic acid (B) in quantities required for giving a weight ratio of (A):(B) of 5:95 to 95:5 and 0.5 to 30% by weight based on dry pulp, of (A) and (B), followed by paper-making.

DETAILED DESCRIPTION OF PREFERRED EMBODIMENTS

The agglomerated particles of urea-formaldehyde polymer used in the present invention are preferred to have an average particle diameter of 0.1 to 0.5μ and an average diameter of the agglomerated particles of 1 to 15μ. If the average particle diameter is less than 0.1μ, the resulting agglomerated particles have a low strength, so that when they are used in the process of paper-making, they collapse due to the pressure applied to the paper during the process of paper-making to make insufficient the objective function of improving the printing opacity. On the other hand, if the average particle diameter exceeds 0.5μ, the resulting coaggregate of associated particles of urea-formaldehyde polymer, white carbon and the alumina polymer (hereinafter abbreviated to "teraggregate") has a low percentage retention in the resulting paper, and also converted paper after printing has a low opacity. The more preferable average particle diameter is in the range of 0.12 to 0.3μ and such a range is usually employed. Further if the average diameter of the agglomerated particles is less than 1μ, the resulting teraggregate has a low retention in the resulting paper, so that converted paper after printing has a low opacity. If the average diameter of the agglomerated particles exceeds 15μ, resulting teraggregate has a high percentage fixation to paper, but it has a low dispensibility in paper so that the printing opacity, the opacity, etc. lower. Further, the more preferable range of the average diameter of agglomerated particles is in the range of 2 to 10μ and such a range is usually employed.

The above-mentioned agglomerated particles of urea-formaldehyde polymer are easily prepared according to a known, optional method. For example, the agglomerated particles are obtained by way of either a one-step process or a two-step process, and in either of the processes, the polymer particles are prepared so as to have an optional ratio by mol of urea to formaldehyde. In more detail, in the case of the two-step process, a water-soluble urea-formaldehyde condensate is firstly formed, followed by curing the water-soluble, initial condensate in the presence of a curing catalyst at an elevated temperature to thereby form agglomerated particles of the polymer.

Further, in the case of a one-step process, all components and additives used for the reaction are first added, and the reaction proceeds directly until the agglomerated particles of the polymer are formed. In the respective cases, the resulting agglomerated particles of urea-formaldehyde polymer are neutralized and washed with water to remove free formaldehyde, or before the neutralization, urea, ammonia, an ammonium salt, sulfurous acid or a sulfite salt is added and reacted to remove free formaldehyde, followed by neutralization, and thereafter filtration or centrifugal separation to recover agglomerated particles of urea-formaldehyde polymer in the form of a cake, or drying the particles in a conventional manner such as spray drying, further air drying and other contact and convectional drying, etc. In the case where the agglomerated particles of urea-formaldehyde polymer are used in the form of a cake or used in the form of a slurry by redispersing the cake, in water milling is carried out before the agglomerated particles are made into a cake-form, to adjust the average diameter of the agglomerated particles preferably to 2 to 10μ. Further in the case where the agglomerated particles of urea-formaldehyde polymer are obtained in a dry state, milling is carried out after drying to adjust the average diameter of the agglomerated particles preferably to 2 to 10μ. The filtrate obtained by the above-mentioned filtration or centrifugal separation is used as water for raw materials or water for adjustment at the prior step.

The curing catalyst usable in the preparation of the agglomerated particles of urea-formaldehyde polymer includes acidic catalysts, for example, a mineral acid such as sulfuric acid, phosphoric acid, hydrochloric acid, nitric acid, organic acids having medium PK values less than 4 such as formic acid, oxalic acid, maleic acid, succinic acid, chloracetic acid or the like acid. Further, sulfamic acid or a water soluble ammonium hydrogensulfate of the formula $RNH_3SO_4H$ (wherein R represents hydrogen, alkyl group, cycloalkyl group, hydroxyalkyl group, aralkyl group, aryl group, etc.) may be also used. The water-soluble ammonium hydrogen sulfate refers to methylammonium hydrogensulfate, ethylammonium hydrogensulfate, hydroxyethylammonium hydrogensulfate, phenylammonium hydrogensulfate, benzylammonium hydrogensulfate, etc.

In order to form particles having a preferable particle diameter in the production of the agglomerated particles of urea-formaldehyde polymer, it is advantageous to add a water-soluble, organic high molecular weight polymer having a function of a protective colloid, to a water-soluble, initial urea-formaldehyde condensate in advance of forming particles of a mixed aqueous solution of urea and formaldehyde. The water-soluble, organic high molecular weight polymer having a function of a protective colloid referred to herein means natural substances such as starch, gelatin, hide glue, tragacanth gum, agar, acacia gum, etc., modified natural substances such as alkali metal salts e.g. sodium salts, potassium salts, etc. of carboxymethyl cellulose, carboxyethyl cellulose, etc., alkali metal salts of methyl cellulose, ethyl cellulose, β-hydroxyethyl cellulose, alginic acid, etc., polyvinyl alcohol, polyvinyl pyrohidone, polyacrylic acid, polymethacrylic acid and alkali metal salts thereof, copolymers of maleic acid with styrene or butylene and salts thereof, salts of homopolymer or copolymers of vinyl pyridine, etc. The quantity of the protective colloid agent used is generally in the range of about 0.1 to 10% by weight (hereinafter % means % by weight), preferably 0.5 to 5% based on the weight of urea and formaldehyde, although it depends on its kind.

Next, an advantageous process for producing the agglomerated particles of urea-formaldehyde will be described in detail.

Usually, a water-soluble, initial urea-formaldehyde condensate in a molar ratio of 1:1 to 1:2 is used as an intermediate raw material, which is obtained by reacting an aqueous solution of urea, formaldehyde and additives having a total concentration of about 20 to 75%, at a temperature of about 30° to 100° C., at a pH of about 5 to 9 and for 10 minutes to 4 hours. As the protective colloid agent, polyvinyl alcohol or sodium salt of carboxymethyl cellulose is used and this may be added at an optional time during the preparation of the water-soluble, initial urea-formaldehyde condensate. As the subsequent step, to the initial condensate containing the protective colloid agent is added a solution of sulfuric acid or sulfamic acid at a temperature of room temperature to about 100° C., with stirring, until gelation occurs, followed by roughly grinding the resulting agglomerated particles into those having a diameter of 1 to 2 mm by means of a pelletizer or a hammer mill, thereafter adding water with stirring to obtain a slurry having a concentration of the agglomerated particles of urea-formaldehyde polymer of 5 to 10%, successively neutralizing the resulting material with aqueous ammonia or an aqueous solution of an alkali such as sodium hydroxide, milling the resulting material into agglomerated particles having a diameter of 2 to 10μ by means of a mill and dehydrating by means of a filtration-dehydrator to obtain cake-form, agglomerated particles of urea-formaldehyde polymer.

The agglomerated particles of hydrated silicic acid used in combination with the above agglomerated particles and others are preferred to have a BET specific surface area (measured according to Brunauer Emette and Teller's method) of 100 to 300 $m^2/g$. If the BET specific surface area is less than 100 $m^2/g$, converted paper obtained using the teraggregate formed from the agglomerated particles of hydrated silicic acid, the agglomerated particles of urea-formaldehyde polymer and the alumina polymer is insufficient in the function of improving the printing opacity. On the other hand, if the BET specific surface area exceeds 300 $m^2/g$, the association strength of the agglomerated particles of hydrated silicic acid is so weak that when the agglomerated particles are used at the step of paper-making, the agglomerated particles collapse due to the pressure applied to the paper during the step of paper-making, and as a result, the aimed function of improving the printing opacity is insufficient. The more preferred BET specific surface area is in the range of 150 to 250 $m^2/g$.

The agglomerated particles of silicic acid having such surface areas are easily prepared according to a known method. In general, the agglomerated particles can be obtained by reacting an alkali silicate and a mineral acid as well as a salt in an aqueous solution, and usually an aqueous solution of a mineral acid prepared so as to have a concentration of 2 to 40 g/100 cc is added to an aqueous solution of an alkali silicate prepared in advance so as to have a concentration of 2 to 9.5 g/100 cc as calculated in terms of silica. The addition reaction is carried out at a temperature of 65° C. or higher. As the method of adding the aqueous solution of a mineral acid, there are a method of adding it continuously and a method of adding it in divided portions, but in the former case of continuous addition, a product having a more stable quality is liable to be obtained, and yet the operation is easier. Usually, in the case of adding it continuously, it is preferred to complete the addition at a time of 50 minutes or shorter. The BET specific surface area of the agglomerated particles of hydrated silicic acid depends mainly upon the addition rate of the mineral acid i.e. the formation rate of particles of hydrated silicic acid. There is a tendency that the lower the addition rate, the smaller the BET specific surface area, while the higher the addition rate, the greater the BET specific surface area.

The alkali silicate as the raw material of the above agglomerated particles of hydrated silicic acid may be those which can be expressed by $SiO_2$/alkali (molar ratio), and currently commercially available water glass may be used at it is. Further, as the mineral acid used as its raw material, mineral acids such as sulfuric acid, hydrochloric acid, nitric acid, etc. are usable, but sulfuric acid is suitable in the aspect of its effect upon the papermaking step.

In the preparation of the agglomerated particles of hydrated silicic acid, various techniques already employed for the preparation of the hydrated silicic acid referred to as white carbon such as techniques of adding sodium sulfate, sodium chloride, etc. or successively raising the reaction temperature are applicable if necessary.

The agglomerated particles of hydrated silicic acid are obtained in the form of slurry as described above, but if necessary, the resulting slurry may be subjected to centrifugal dehydration or filtration-dehydration to obtain a cake-form material, or this cake-form material may be further dried to obtain a powdery material. When such a cake-form or powdery material is used, it is returned to a slurry by adding water.

In the practice of the present invention, it is necessary to add to aluminium salt for forming 0.015 to 1.2% based on dry pulp, of an alumina polymer, into a pulp slurry. If the proportion of the alumina polymer is less than 0.015% or exceeds 1.2%, the teraggregate formed from the alumina polymer, the agglomerated particles of ureaformaldehyde polymer (A) and the agglomerated particles of hydrated silicic acid (B) has a low percentage retention thereof in paper, so that it is impossible to acquire as sufficient opacity of converted paper after printing and opacity and an improved brightness. The quantity of the alumina polymer formed is preferred to be in the range of 0.04 to 0.75% . As the aluminium salt used for forming the alumina polymer, aluminium sulfate, aluminum chloride, sodium aluminate, etc. are usable, but use of aluminum sulfate is preferred in view of stabilized formation of the alumina polymer. Aluminum sulfate is expressed by the formula $Al_2(SO_4)_3$ and this is hydrolyzed in pulp slurry to form an aluminum hydroxide polymer having cations. The quantity by weight of this aluminum hydroxide polymer prepared refers to the quantity calculated in terms of $Al_2O_3$ from the total quantity of the aluminum salt added and the aluminum salt contained in white water circulated.

The agglomerated particles of urea-formaldehyde polymer (A) and the agglomerated particles of hydrated silicic acid (B) bear a negative potential in the suspension state in water. It is presumed that the alumina polymer having cationic properties is adsorbed to these agglomerated particles having a negative potential to afford a cohesion by which the coaggregate of both the agglomerated particles is formed, and at the same time, further reinforce the fixability of the agglomerated particles of urea-formaldehyde polymer (A) onto pulp.

The present invention is characterized by paper-making using the agglomerated particles of urea-formaldehyde polymer (A) and the agglomerated particles of hydrated silicic acid (B) so as to give a ratio by weight of (A):(B) of 5:95 to 95:5 and a total weight of (A) and (B) of 0.5 to 30% based on dry pulp. If the proportion of (A) is smaller in a ratio of 5:95, the teraggregate has a low percentage fixation thereof onto paper and the resulting converted paper is insufficient in the printing opacity, the brightness and the opacity. On the other hand, if the proportion of (B) is smaller in a ratio of 95:5, the resulting teraggregate has a high percentage fixation thereof onto paper, but the resulting converted paper is insufficient in the printing opacity. The ratio of (A):(B) is preferred to be in the range of 20:80 to 80:20. Further the total weight of (A) and (B) is in the range of 0.5 to 30% based on dry pulp. The reason is that if the total weight of (A)+(B) is less than 0.5%, the resulting converted paper is low in the printing opacity, the opacity and the percentage of improvement in the brightness; hence the object cannot be achieved. On the other hand, if the total weight of (A) and (B) exceeds 30%, the resulting converted paper has a low strength and the so-called powder drop from paper is observed to occur; hence it is impossible to sufficiently effect the function of paper. Thus the total weight of (A) and (B) is preferred to be in the range of 1 to 15%.

When the agglomerated particles (A) and (B) are added to pulp slurry, the agglomerated particles of hydrated silicic acid and the agglomerated particles of urea-formaldehyde polymer have different percentages retention, respectively, as described later; hence the quantities of both the agglomerated particles are determined so that the ratio by weight of (A):(B) and the total weight of (A) and (B) may fall in definite ranges, respectively, taking into account the percentages retention thereof.

When an aluminum salt, the agglomerated particles of urea-formaldehyde polymer (A) and the agglomerated particles of hydrated silicic acid (B) are added to pulp slurry, the addition site thereof may be an optional site between the refiner and the fan pump at the paper-making step, and both the agglomerated particles added are desired to be uniformly dispersed in pulp slurry; thus conventional methods may be employed for agitating and dispersing them. Further, the addition order thereof has no particular limitation, but it is preferred in the aspect of forming the coaggregate to mix the agglomerated particles of urea-formaldehyde polymer (A) with the agglomerated particles of hydrated silicic acid (B) in advance, followed by adding the mixture or to add both the agglomerated particles as successively as possible even when they are individually added. When the aluminum salt and both the agglomerated particles are added to pulp slurry, they are each prepared in advance into an aqueous solution or slurry having a concentration in which the addition quantity is easily adjusted, but the concentration is preferred to be as low as possible, from the viewpoint of a uniform dispersibility thereof in pulp slurry. Usually, pulp slurry having added an aluminum salt and both the agglomerated particles each prepared so as to have a concentration of 10% or lower is formed into a thin paper on the wire of an elongated wire paper machine, a cylindrical wire paper machine or a twin wire paper machine. Usually, by further dehydrating the paper by means of a press roll, drying by means of a dryer and finally subjecting it to calender treatment, it is possible to easily produce the lightweight paper of the present invention.

Depending on the use applications of the lightweight paper of the present invention, it is preferred to add an additive or an adjusting agent generally and conventionally used, into pulp slurry having added an aluminum salt and both the agglomerated particles.

It is possible to usually add into pulp slurry, for example, sizing agents such as rosin sizes, synthetic sizes, reactive sizes, paper strength-reinforcing agents such as those of starch and gums, acrylamides, ureas, melamines, chlorohydrins, etc., water filtration-improving agents such as those of ethylene-imines, polyamides, acrylamides, etc., retention aids such as those of acrylamides, formation-improving adhesives, dyes, detergents, wetting agents, pitch-control agents, etc. It is apparent that the present invention also comprises lightweight paper containing such other additives.

The above-mentioned lightweight paper of the present invention has a function of highly improving the printing opacity while retaining the function of improving the opacity and a high fixability, and the above-mentioned process for producing the lightweight paper of the present invention is a process which makes easy the production of the lightweight paper having the above-mentioned properties and is effective for making paper lightweight.

The present invention will be described by way of examples in more detail, but it should not be construed to be limited thereto.

EXAMPLE A-1

Into a flask were fed water (20.00 parts by weight) (hereinafter all parts being by weight) and sodium salt of carboxymethyl cellulose (Cellogen F-3H, tradename of product manufactured by Daiichi Kogyo Seiyaku Kabushiki Kaisha) (0.325 part), followed by dissolving these materials, adding a 37% aqueous solution of formaldehyde (18.24 parts), heating the mixture to 70° C. with stirring, adjusting, at the same time, the pH to 7.5 with an aqueous solution of NaOH, thereafter adding urea (9 parts), and subjecting the mixture to condensation reaction at 70° C. for 2.0 hours to obtain an initial urea-formaldehyde condensation reaction product, cooling this product to about 45° C., and rapidly and uniformly mixing it with a solution obtained by diluting 95% sulfuric acid (0.46 part) with water (15.73 parts). After 10 seconds, the reaction mixture cured and at that time its temperature rose up to 61° C. The solidified material was then kept at about 60° C. for one hour, followed by roughtly grinding it into particles having a size of 1~2 mm by means of a cutter granulator, adding water (100 parts) to obtain a slurry-form material, neutralizing it with a 20% aqueous solution of NaOH to make its pH 7.5, milling the resulting slurry by means of a mill, and filtration-dehydrating it to obtain a white cake-form material (60.2 parts). A portion thereof was dried by hot air at 105° C. for 2 hours and the concentration of the agglomerated particles of urea-formaldehyde polymer in the cake-form material was measured to give 20.1%. Thus, 12.10 parts of the agglomerated particles (A) were obtained. The agglomerated particles had an average particle diameter of 0.2μ as measured by means of the photograph of an electron microscope, and also had an average diameter of 5.1μ as measured by means of a Coulter Counter (Model TA II manufactured by Coulter Counter Inc.) and calculated.

The agglomerated particles of urea-formaldehyde polymer obtained in this example are referred to as UF-1.

EXAMPLES A-2 to A-9

Agglomerated particles of urea-formaldehyde polymer (hereinafter referred to as UF) were obtained in the same manner as in Example A-1 except varying the tradename and amount of carboxymethyl cellulose sodium salt used and the clearane of colloid mill (TK Micolloidal L type, manufactured by Tokushu Kika Kogyo, Inc.) as set forth in Table X-1. The results obtained are set forth in Table 1.

TABLE X-1

| Examples | UF | Carboxymethyl cellulose: Trade-names | Carboxymethyl cellulose: Makers | Carboxymethyl cellulose: Amounts, Parts | Clearance of colloid mill, μm |
|---|---|---|---|---|---|
| A-1 | UF-1 | Cellogen F-3H | Daiichi Kogyo Seiyaku K.K. | 0.325 | 35 |
| A-2 | Uf-2 | Hi-Sunlose H750 | Sanyo Kokusaku Pulp.Inc. | 0.500 | 35 |
| A-3 | UF-3 | Sunlose F50MC | Sanyo Kokusaku Pulp. Inc. | 0.325 | 35 |
| A-4 | UF-4 | Cellogen F-3H | As the above | 0.325 | 20 |
| A-5 | UF-5 | Cellogen F-3H | As the above | 0.325 | 50 |
| A-6 | UF-6 | Sunlose PN-01A | Sanyo Kokusaku Pulp. Inc. | 0.500 | 35 |
| A-7 | UF-7 | Cellogen F-3H | As the above | 0.170 | 35 |
| A-8 | UF-8 | Hi-Sunlose H-750 | As the above | 0.325 | 15 |
| A-9 | UF-9 | Cellogen F-3H | As the above | 0.325 | 70 |

TABLE 1

| Example | UF | Average particle diameter (μ) | Average diameter of agglomerated particles (μ) | Cake concentration (%) |
|---|---|---|---|---|
| A-1 | UF-1 | 0.20 | 5.1 | 20.1 |
| A-2 | UF-2 | 0.12 | 5.2 | 19.3 |
| A-3 | UF-3 | 0.30 | 5.1 | 22.4 |
| A-4 | UF-4 | 0.21 | 2.2 | 20.3 |
| A-5 | UF-5 | 0.20 | 9.8 | 20.2 |
| A-6 | UF-6 | 0.09 | 4.9 | 17.9 |
| A-7 | UF-7 | 0.65 | 6.4 | 23.4 |
| A-8 | UF-8 | 0.15 | 0.87 | 19.7 |
| A-9 | UF-9 | 0.23 | 20.6 | 20.8 |

EXAMPLE B-1

Sodium silicate (246 cc) having a molar ratio of $SiO_2/Na_2O$ of 3.02 and a content of $SiO_2$ of 19.5 g/100 cc was diluted into 1,200 cc with water to prepare an aqueous solution of sodium silicate having a concentration of $SiO_2$ of 4 g/100 cc, as a raw material. Into a 2 l flask equipped with heating and cooling means, an agitator and a thermometer was placed the above aqueous solution of sodium silicate as a raw material, followed by raising the temperature up to 90° C. with stirring at 1,000 rpm, and adding 2N sulfuric acid for 40 minutes while heating the mixture so as to keep 90° C., to make the final pH 8.0. The resulting agglomerated particles of hydrated silicic acid (B) had a slurry concentration of about 3.8%. This slurry was subjected to filtration-dehydration to obtain a cake-form material. A portion thereof was dried in hot air at 105° C. for 2 hours and the concentration of the cake was measured to give 21.3%. Further the BET specific surface area was 150 $m^2/g$. The agglomerated particles of hydrated silicic acid obtained in this Example are referred to as WC-1.

EXAMPLES B2 to B5

Agglomerated particles of hydrated silicic acid (hereinafter referred to as WC) were obtained in the same manner as in Example B-1 except varying the $SiO_2$ concentration of the aqueous solution of sodium silicate and the dropping speed of 2N sulfuric acid as indicated in Table X-2. The obtained results are set forth in Table 2.

TABLE X-2

| Examples | WC | $S_iO_2$ concentration, g/100 cc | Dropping speed of 2N $H_2SO_4$, minutes |
|---|---|---|---|
| B-1 | WC-1 | 4 | 40 |
| B-2 | WC-2 | 9 | 13 |
| B-3 | WC-3 | 15 | 60 |
| B-4 | WC-4 | 20 | 60 |
| B-5 | WC-5 | 9 | 1 |

TABLE 2

| Example | WC | BET specific surface area ($m^2/g$) | Cake concentration (%) |
|---|---|---|---|
| B-1 | WC-1 | 150 | 21.3 |
| B-2 | WC-2 | 250 | 21.5 |
| B-3 | WC-3 | 100 | 20.6 |
| B-4 | WC-4 | 80 | 22.8 |
| B-5 | WC-5 | 350 | 21.8 |

EXAMPLES 1~5 and COMPARATIVE EXAMPLES 1~5

Among A-1~5 and B-1~3 in the preparation Examples of the agglomerated particles of urea-formaldehyde polymer (A) and the agglomerated particles of hydrated silicic acid (B), UF-1 and WC-1 the values of physical properties of which are close to the central values within the limited ones were combined to evidence the usefulness of the present invention.

An aqueous solution of aluminum sulfate having a concentration of 3.06% as calculated in terms of $Al_2O_3$ (the proportion of alumina being about 0.31% by weight based on dry pulp) (2.0 parts) was added into a 1% pulp slurry (20.00 parts) having blended therein NB.KP (25 parts), TMP (30 parts), RGP (20 parts) and deinked newspaper (25 parts) and having a beating degree (CSF) of 330 ml, followed by agitating the mixture for 2 minutes, succesively adding a previously prepared, mixed slurry of UF-1 and WC-1 in a ratio by solids weight of the respective associated particles of 50:50 and having a concentration of 5% in total (40 parts) (the proportion of both the agglomerated particles being 10% based on dry pulp), and agitating the mixture for 5 minutes to obtain a prepared slurry, then subjecting it to paper-making by means of a TAPPI standard rectangular sheet machine, carrying out press-dehydration, drying the resulting wet paper on a drum dryer having a surface temperature of 110° C., thereafter twice passing it through under a linear pressure of 40 kg/cm, and seasoning it in a thermohygrostal at a humidity of 65% and a temperature of 20° C. for 24 hours to obtain a converted paper of Example 1.

With the converted paper obtained in Example 1, measurements of its physical properties such as basic weight, percentage retention, smoothness, bulk density, brightness, opacity, printing opacity, etc. and calculations were carried out.

The results are shown in Table 1.

Converted papers of Examples 2~5 and Comparative examples 1~4 were obtained in the same manner as that in the production of the converted paper of Example 1 except that the blending ratio of UF-1 and WC-1 was varied. Further, a converted paper of Comparative examples 5 was obtained in the same manner as that in the process for producing the converted paper of Example 1 except that the agglomerated particles were not added. With the converted papers of Examples 2~5 and Comparative examples 1~5, too, measurements of their physical properties and calculations were carried out in the same manner as that in the case of the converted paper of Example 1. The results are shown in Table 3.

In addition, the methods of measurements of physical properties of paper and calculations are as follows:

The basic weight was measured and calculated by the treatment according to JIS (P-8111).

The bulk density was determined by measurement of the thickness of paper according to JIS (P-8118) and calculation from an equation of basic weight/thickness×1,000.

The smoothness was measured by menas of Bekk smoothness tester according to the method stated in JIS (P-8119) and TAPPI (Standard method T479).

The brightness was measured using a blue filter by means of Hunter meter. Opacity was measured according to JIS (P-8138).

Printing opacity was measured according to a method described in a literature (Paper and Pulp Art Times, September, 1979, page 1-13).

The percentage retention of UF in the converted paper is calculated by measuring the fixed amount of solids of UF added to dry pulp. In accordance with the method of TAPPI-T418 SU-72, the nitrogen content in paper (hereinafter referred to as $N_1$%) is measured and the nitrogen content in UF (hereinafter referred to as $N_0$%) is calculated. For example, the $N_0$ in the solids of UF-1 is 28%. The amount of UF in the converted paper (hereinafter referred to as UF-Y %) is calculated as follows:

$$UF - Y = \frac{N_1}{N_0} \times 100\ (\%)$$

Then, the percentage retention of UF (hereinafter referred to as UF-X %) is calculated as follows:

$$UF - X \frac{UF - Y}{\text{Amount of } UF \text{ added to dry pulp}} \times 100\ (\%)$$

The percentage retention of WC in the converted paper is calculated by measuring the content of hydrated silicic acid particles in paper (hereinafter referred to as $\omega_1$%) in accordance with the method of TAPPI-T413-ts-66 and the amount of hydrated silicic acid particles added to dry pulp (hereinafter referred to as $\omega_0$%) is calculated.

$$\text{Percentage retention of } WC = \frac{\omega_1}{\omega_0} \times 100\ (\%)$$

In the measurement of percentage retention of UF, the above $N_1$ is determined by deducting the nitrogen content contained in the pulp itself.

In the measurement of percentage retention of WC, the above $\omega_1$% is determined by deducting the ash content in converted paper obtained in the same procedure and conditions except not adding WC.

TABLE 3

| | Example | | | | | Comparative example | | | | |
|---|---|---|---|---|---|---|---|---|---|---|
| | 1 | 2 | 3 | 4 | 5 | 1 | 2 | 3 | 4 | 5 |
| Amount of alumina added (%) | 0.31 | 0.31 | 0.31 | 0.31 | 0.31 | 0.31 | 0.31 | 0.31 | 0.31 | 0.31 |
| Amount of Agglomerated particles added (%) | 10 | 10 | 10 | 10 | 10 | 10 | 10 | 10 | 10 | — |
| UF-1:WC-1 ratio | 50:50 | 35:65 | 20:80 | 65:35 | 80:20 | 97:3 | 3:97 | 100:0 | 0:100 | — |
| Percentage retention of U/F/WC (%) | 57.8/49.5 | 57.3/49.2 | 58.1/48.8 | 57.4/50.4 | 56.1/50.7 | 55.8/56.3 | 60.3/38.9 | 55.7/— | —/38.4 | — |
| Basic weight (g/cm$^2$) | 45,1 | 45,0 | 45,1 | 45,2 | 45,0 | 45,2 | 45,1 | 45,2 | 45.1 | 45.0 |
| Bulk density (g/cm$^3$) | 0.64 | 0.63 | 0.64 | 0.65 | 0.64 | 0.63 | 0.64 | 0.63 | 0.64 | 0.65 |
| Smoothness (sec) | 47 | 45 | 45 | 48 | 44 | 47 | 45 | 48 | 45 | 47 |
| Brightness (%) | 56.6 | 56.1 | 53.5 | 56.9 | 57.3 | 57.3 | 50.5 | 57.4 | 50.4 | 50 |
| Opacity (%) | 95.4 | 95.2 | 95.0 | 95.5 | 95.4 | 95.5 | 93.5 | 95.7 | 93.2 | 89.5 |
| Printing Opacity (%) | 80.9 | 79.4 | 78.9 | 81.2 | 80.4 | 77.3 | 77.4 | 77.4 | 77.5 | 73.4 |

As apparent from Table 3, the converted papers of Examples 1~5 have higher percentages retention than those of the converted papers of Comparative examples 1~4 although the basic weight, bulk density, smoothness, etc. are the same, so that the former converted papers exhibit higher printing opacities than those of particularly Comparative examples 3 and 4 wherein the agglomerated particles are singly added, while retaining higher brightness and opacity.

EXAMPLES 6~20

Paper-making was carried out in the same manner as in Example 1, fixing the simultaneous use ratio of the agglomerated particles of urea-formaldehyde polymer (A) to the agglomerated particles of hydrated silicic acid (B) to 60:40 and also fixing the total quantity of these agglomerated particles added, to 10%, except that the other factors were varied, followed by measurement of the physical properties of the resulting converted papers and calculation. The results are shown in Table 4.

As apparent from Table 4, the converted papers obtained under the conditions of the present inventions are improved in any of brightness, opacity and printing opacity.

EXAMPLES 21~29 AND COMPARATIVE EXAMPLE 6

The instant Examples and Comparative example illustrate making paper lightweight.

In Examples 21~29, converted papers were obtained under the same conditions and process as those in Example 1 except that under the paper-making conditioned of Example 1, aluminum sulfate was added to pulp slurry, followed by further adding a maleic rosin size in a quantity of 0.15% by weight based on dry pulp; the quantities of UF-1 and WC-1 added were varied and the simultaneous use ratio thereof was changed to 60:40; and the basic weight of paper was varied. Further, in comparative example 6, converted paper was obtained under the same conditions and process as those in Examples 21~29 except that UF-1, WC-1 and maleic rosin were not added and the basic weight of made paper was 50 g/m$^2$. The resulting respective converted papers were subjected to the same evaluation of physical properties as that carried out in Example 1, and further, a test of water absorption properties was carried out. The paper-making conditions, measurements of physical properties and calculation results of these converted papers are shown in Table 5.

TABLE 4

| | Example | | | | | | | | | | | | | | |
|---|---|---|---|---|---|---|---|---|---|---|---|---|---|---|---|
| | 6 | 7 | 8 | 9 | 10 | 11 | 12 | 13 | 14 | 15 | 16 | 17 | 18 | 19 | 20 |
| UF | | | | | | | | | | | | | | | |
| UF-No. | 1 | 2 | 3 | 4 | 5 | 1 | 1 | 6 | 7 | 8 | 9 | 1 | 1 | 1 | 1 |
| Average particle diameter (μ) | 0.20 | 0.12 | 0.30 | 0.21 | 0.20 | 0.20 | 0.20 | 0.09 | 0.65 | 0.15 | 0.23 | 0.20 | 0.20 | 0.20 | 0.20 |
| Average diameter of Agglomerated particles (μ) | 5.1 | 5.2 | 5.1 | 2.2 | 9.8 | 5.1 | 5.1 | 4.9 | 6.4 | 0.87 | 20.6 | 5.1 | 5.1 | 5.1 | 5.1 |
| WC | | | | | | | | | | | | | | | |
| WC-No. | 1 | 1 | 1 | 1 | 1 | 2 | 3 | 1 | 1 | 1 | 1 | 4 | 5 | 1 | 1 |
| BET specific surface area (m$^2$/g) | 150 | 150 | 150 | 150 | 150 | 250 | 100 | 150 | 150 | 150 | 150 | 80 | 350 | 150 | 150 |
| Simultaneous use ratio of UF:WC | 60/40 | 60/40 | 60/40 | 60/40 | 60/40 | 60/40 | 60/40 | 60/40 | 60/40 | 60/40 | 60/40 | 60/40 | 60/40 | 60/40 | 60/40 |
| Total amount of UF and WC added (%) | 10 | 10 | 10 | 10 | 10 | 10 | 10 | 10 | 10 | 10 | 10 | 10 | 10 | 10 | 10 |
| Amount of alumina added (%) | 0.31 | 0.31 | 0.31 | 0.31 | 0.31 | 0.31 | 0.31 | 0.31 | 0.31 | 0.31 | 0.31 | 0.31 | 0.31 | 0.005 | 0.90 |
| Percentage retention of UF/WC (%) | 57.2/50.5 | 57.4/50.8 | 57.6/50.9 | 56.4/50.4 | 58.8/51.2 | 57.5/51.8 | 57.6/50.9 | 57.3/50.6 | 58.1/50.8 | 49.9/50.3 | 60.8/51.9 | 57.5/50.7 | 57.8/51.8 | 57.4/40.9 | 56.8/40.7 |
| Basic weight (g/m$^2$) | 45.2 | 45.0 | 45.2 | 45.1 | 45.2 | 45.0 | 45.1 | 45.2 | 45.2 | 45.0 | 45.1 | 45.1 | 45.0 | 45.2 | 45.1 |
| Bulk density (g/cm$^3$) | 0.62 | 0.64 | 0.64 | 0.62 | 0.63 | 0.62 | 0.64 | 0.63 | 0.62 | 0.64 | 0.63 | 0.63 | 0.62 | 0.64 | 0.62 |
| Smoothness (sec) | 46 | 44 | 47 | 44 | 46 | 45 | 46 | 47 | 44 | 46 | 47 | 45 | 45 | 47 | 46 |
| Brightness (%) | 56.7 | 56.2 | 56.1 | 56.8 | 56.7 | 56.5 | 56.6 | 51.9 | 52.1 | 53.2 | 53.5 | 56.5 | 56.6 | 56.5 | 55.1 |
| Opacity (%) | 95.3 | 95.1 | 94.9 | 95.1 | 95.4 | 95.3 | 95.4 | 93.8 | 94.1 | 94.5 | 94.4 | 95.2 | 95.4 | 95.5 | 94.8 |
| Printing Opacity (%) | 81.0 | 82.1 | 80.3 | 80.1 | 80.2 | 81.5 | 80.6 | 75.8 | 74.3 | 75.9 | 76.3 | 75.4 | 76.4 | 76.5 | 76.8 |

In addition, the test of water absorption properties was carried out by dropwise adding distilled water (0.04 ml) onto paper surface by means of a syringe and measuring the time by which water drops were absorbed and extinct on the paper surface.

As apparent from Table 5, by the simultaneous use of the agglomerated particles of urea-formaldehyde polymer and the agglomerated particles of hydrated silicic acid, it is possible to make paper lightweight, while retaining the opacity and the printing opacity, that is, without reducing the percentage print through.

TABLE 5

| | Example | | | | | | | | | Comp. ex. |
|---|---|---|---|---|---|---|---|---|---|---|
| | 21 | 22 | 23 | 24 | 25 | 26 | 27 | 28 | 29 | 6 |
| Amount of Agglomerated particles added (%) | 2 | 2 | 2 | 5 | 5 | 5 | 10 | 10 | 10 | — |
| Simultaneous use of U/F-1:WC-1 | 60/40 | 60/40 | 60/40 | 60/40 | 60/40 | 60/40 | 60/40 | 60/40 | 60/40 | — |
| Amount of alumina added (%) | 0.31 | 0.31 | 0.31 | 0.31 | 0.31 | 0.31 | 0.31 | 0.31 | 0.31 | 0.31 |
| Basic weight (g/m$^2$) | 46 | 44 | 42 | 46 | 44 | 42 | 46 | 44 | 42 | 50 |
| Bulk density (g/cm$^3$) | 0.62 | 0.64 | 0.64 | 0.63 | 0.65 | 0.64 | 0.63 | 0.64 | 0.65 | 0.63 |
| Smoothness (sec) | 48 | 46 | 45 | 47 | 45 | 46 | 46 | 45 | 44 | 47 |
| Brightness (%) | 51.5 | 51.4 | 51.6 | 53.3 | 53.4 | 53.3 | 56.8 | 56.7 | 56.8 | 50.1 |
| Opacity (%) | 92.7 | 91.4 | 90.1 | 93.6 | 92.5 | 91.2 | 95.9 | 94.9 | 93.5 | 92.5 |
| Printing Opacity (%) | 76.2 | 73.1 | 70.8 | 78.4 | 76.1 | 73.8 | 80.7 | 78.6 | 76.9 | 76.1 |
| Water absorption degree (sec) | 10 | 9 | 10 | 8 | 9 | 9 | 6 | 6 | 5 | 6 |

What is claimed is:

1. A process for producing a lightweight paper, which process comprises adding into a pulp slurry, an aluminum salt in a quantity required for forming 0.015 to 1.2% by weight based on dry pulp, of an alumina polymer and further adding a mixture of agglomerated particles of urea-formaldehyde polymer (A) and agglomerated particles of hydrated silicic acid (B) thereby forming a teraggregate of (A)/(B)/alumina polymer, said urea-formaldehyde particles having an average particle diameter of 0.1 to 0.5$\mu$ and an average agglomerated particles diameter of 1 to 15$\mu$, and said silica acid particles having a BET specific surface area of 100 to 300 m/g, in quantities required for giving a ratio of (A):(B) in the range of 5:95 to 95:5 and 0.5 to 30% by weight based on dry pulp, or (A) and (B), followed by paper-making.

2. A process according to claim 1 wherein the ratio of (A):(B) is in the range of 20:80 to 80:20 and the total weight based on the pulp, of (A) and (B) is in the range of 1 to 15% by weight.

3. A process according to claim 1 wherein said alumina polymer is formed from aluminum sulfate, aluminum chloride or sodium aluminate.

4. A process according to claim 1 wherein the quantity of said alumina polymer is in the range of 0.04 to 0.75% by weight based on said pulp.

5. A lightweight paper obtained by the process according to claim 1.

* * * * *